US006895621B2

(12) United States Patent
Stone

(10) Patent No.: US 6,895,621 B2
(45) Date of Patent: May 24, 2005

(54) LOW PRESSURE STEAM JET FABRIC FINISHER

(76) Inventor: Neal C. Stone, P.O. Box 425, Healdsburg, CA (US) 95448

( * ) Notice: Subject to any disclaimer, the term of this patent is extended or adjusted under 35 U.S.C. 154(b) by 527 days.

(21) Appl. No.: 10/149,374

(22) PCT Filed: Dec. 22, 2000

(86) PCT No.: PCT/US00/35403

§ 371 (c)(1),
(2), (4) Date: Jun. 5, 2002

(87) PCT Pub. No.: WO01/48296

PCT Pub. Date: Jul. 5, 2001

(65) Prior Publication Data

US 2003/0000022 A1 Jan. 2, 2003

(51) Int. Cl.[7] ..... D06B 5/08

(52) U.S. Cl. ..... 8/154; 8/155.1; 68/189; 68/5 C; 68/5 E

(58) Field of Search ..... 8/154, 155.1; 68/5 C, 68/5 D, 5 E, 189, 198

(56) References Cited

U.S. PATENT DOCUMENTS

| | | | | | |
|---|---|---|---|---|---|
| 1,850,124 | A | * | 3/1932 | Bean | 68/189 |
| 1,933,980 | A | * | 11/1933 | Hornbuckle et al. | 68/189 |
| 1,948,568 | A | * | 2/1934 | Faber et al. | 8/477 |
| 2,109,894 | A | * | 3/1938 | Abbott | 68/189 |
| 2,194,877 | A | * | 3/1940 | Steiger | 68/189 |
| 2,446,502 | A | * | 8/1948 | Wehrli | 8/149.1 |
| 2,779,977 | A | * | 2/1957 | Wilkie | 19/66 R |
| 2,990,087 | A | * | 6/1961 | Brewin et al. | 223/76 |
| 3,315,499 | A | * | 4/1967 | Westall | 68/12.07 |
| 3,751,945 | A | * | 8/1973 | Eschenbach et al. | 68/5 C |
| 3,914,962 | A | * | 10/1975 | Doire et al. | 68/8 |
| 3,916,653 | A | * | 11/1975 | West et al. | 68/15 |
| 3,967,923 | A | * | 7/1976 | Ameling | 8/149.1 |
| 4,183,233 | A | * | 1/1980 | Brown | 68/5 C |
| 4,264,993 | A | * | 5/1981 | Freeman et al. | 8/149 |

FOREIGN PATENT DOCUMENTS

| | | | |
|---|---|---|---|
| FR | 2638468 | * | 5/1990 |
| JP | 58-36261 | * | 3/1983 |
| JP | 62-41367 | * | 2/1987 |
| JP | 3-32697 | * | 2/1991 |

* cited by examiner

*Primary Examiner*—Frankie L. Stinson
(74) *Attorney, Agent, or Firm*—Craig M. Stainbrook; Larry D. Johnson; Johnson & Stainbrook, LLP

(57) ABSTRACT

A low pressure steam jet fabric finisher (10) for steam setting of dyes on fabric during a steaming cycle, having a substantially cuboid housing (12) which defines a water reservoir (70) with a heating element (72) and a cylindrical steaming chamber (88). Steam from heated water rises into the steaming core (80) having an inlet (84) in fluid communication with the water reservoir (70) and thereafter into the steaming chamber (88) through a plurality of holes in the steaming core (80). Dyed fabric is rolled onto a helical coil spring (90) which is inserted over the steaming core (80) and placed in the steaming chamber (88) for dye setting during a steaming cycle.

10 Claims, 4 Drawing Sheets

LOW PRESSURE STEAM JET FABRIC FINISHER

BACKGROUND OF THE INVENTION

1. Technical Field

The present invention relates generally to fabric steamers, and more particularly to a production level low pressure steam jet fabric finisher for batch steam setting of fabrics dyed by digital printers or other conventional means.

2. Background Art

Fabrics printed with dyes must be steam treated to fix or set the dyes. Unfortunately, advances in fabric dye setting processes have not kept pace with the many recent advances in printing on textiles, both with respect to conventional screen and roller printing, and with respect to ink jet printing. Accordingly, there remains a need for an effective method for rapidly and thoroughly fixing inks and dyes on fabric: the purposes being to prevent backstaining and the migration of low viscosity inks and dyes, to prevent the fixation process from becoming a production bottleneck, to facilitate post-fixation handling and processing and to ensure washability and color fastness.

DISCLOSURE OF INVENTION

The fully automatic low pressure steam jet fabric finisher of the present invention comprises a stainless steel elongate cuboid housing having dimensions suitable for steam setting a large, elongate bolt of fabric. The front side of the housing has a front lockout door that provides access to a hollow cylindrical steaming chamber which runs longitudinally almost the entire length of the steamer to within a few inches of the back side of the housing. Supported concentrically within the steaming chamber is a hollow cylindrical steaming core having a plurality of holes through its sides for the passage of steam from the steaming core into the steaming chamber. The front side further includes a control panel for operator control of the steamer, which includes a pressure gauge, a temperature gauge, an electronic timer and temperature control, a cycle indicator light, a door lock indicator light, water full and add water indicator lights, a power/start cycle switch, a power on indicator light, a heater on indicator light, and an emergency shut-off knob.

The steamer interior includes a water reservoir into which a heating element is positioned. The heating element is powered by single phase power and heats water to produce steam up to a temperature of 250° F. (121° C.) or higher. The cylindrical hollow steaming core extends longitudinally from the front door and to a steam inlet near the top of the water reservoir, with which it is in open communication. Steam generated by the heating element rises from the reservoir and migrates into the steaming core through the steam inlet and passes through a plurality of holes through the cylinder walls of the steaming core and into the steaming chamber. When dyed and printed fabrics are to be steam fixed, the dyed or printed fabric is rolled into a layered sandwich over a helical spring coil which slides over the steaming core, and the rolled fabric is processed in a steam cycle suited to the fabric and dyes used.

BEST MODE FOR CARRYING OUT THE INVENTION

The present invention comprises a fully automatic low pressure jet steam fabric finisher, and a method of using the same, for rapid and thorough fixation of fabric dyes and inks. The disclosed apparatus and process increase productivity by reducing the fixation cycle time, by thoroughly fixing fabric dyes and inks so that the post-fixation wash cycle is also reduced, and by producing consistent results. The inventive fabric finisher is particularly well-suited for the entire range of digital ink printing production settings.

Figure 1:
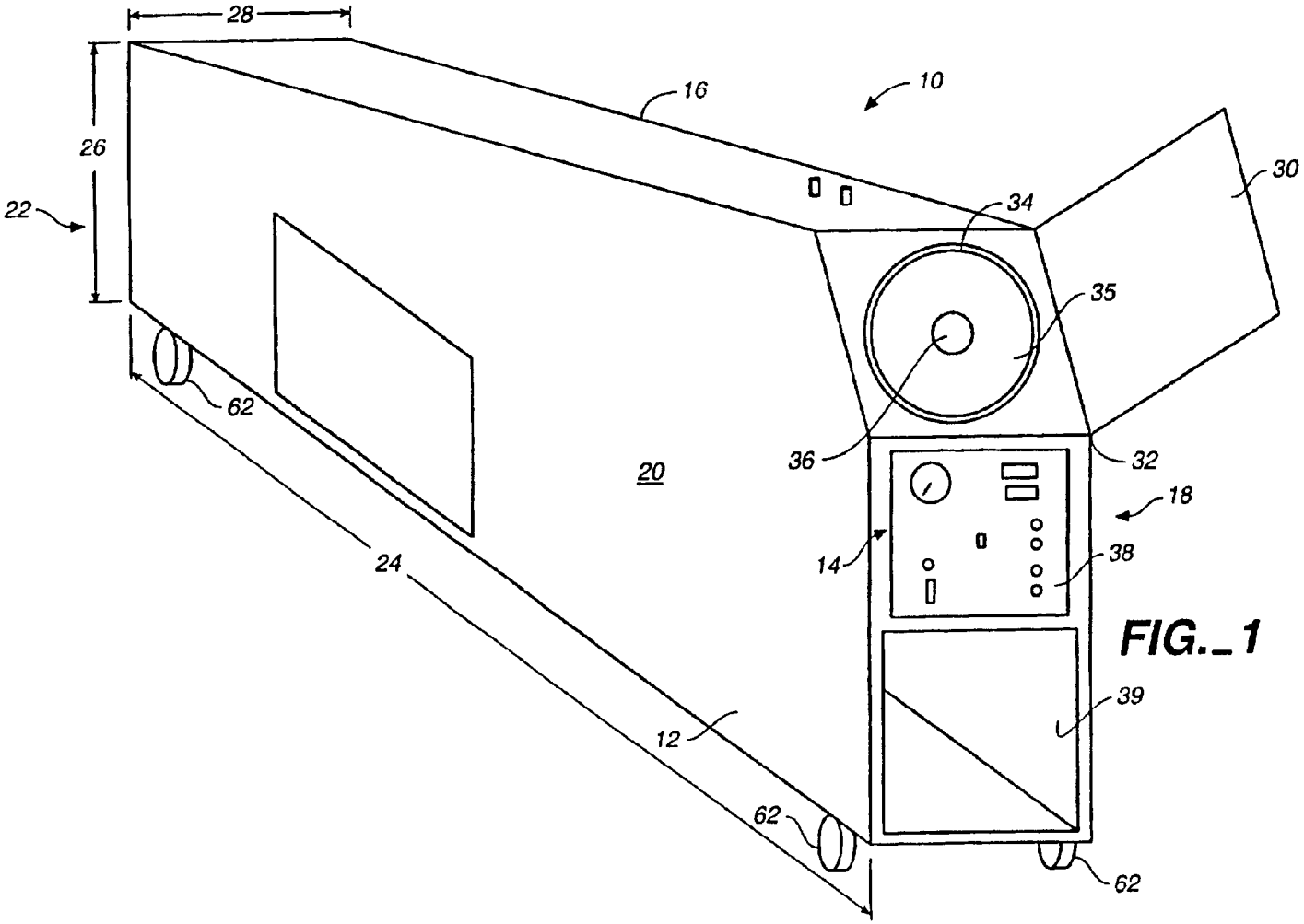
FIG. 1 is a perspective view of the jet steam fabric finisher of the present invention, showing the door of the steaming core open.
Figure 2:
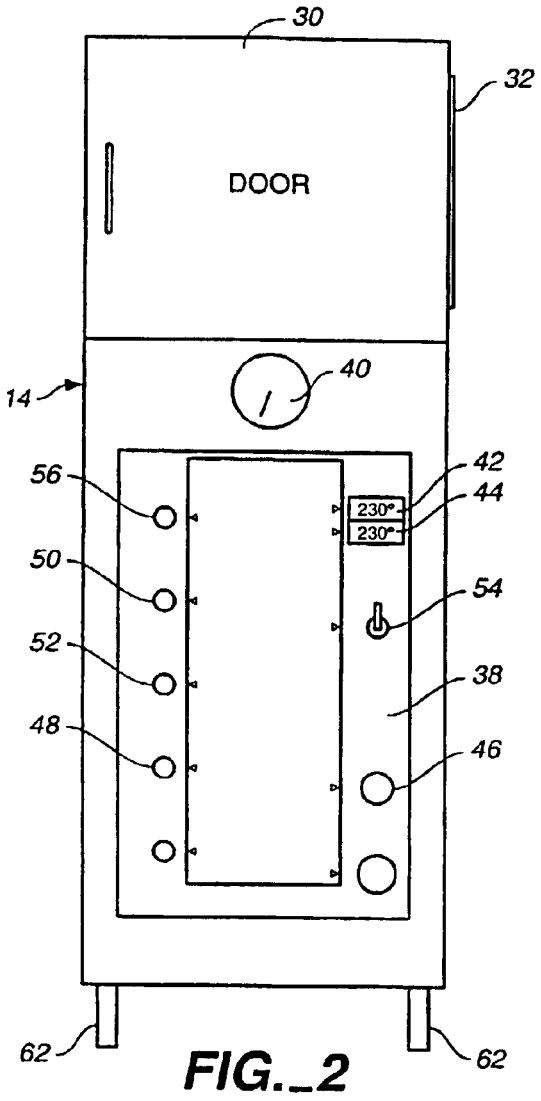
FIG. 2 is a front view in elevation of the jet steam fabric finisher.
Figure 3:
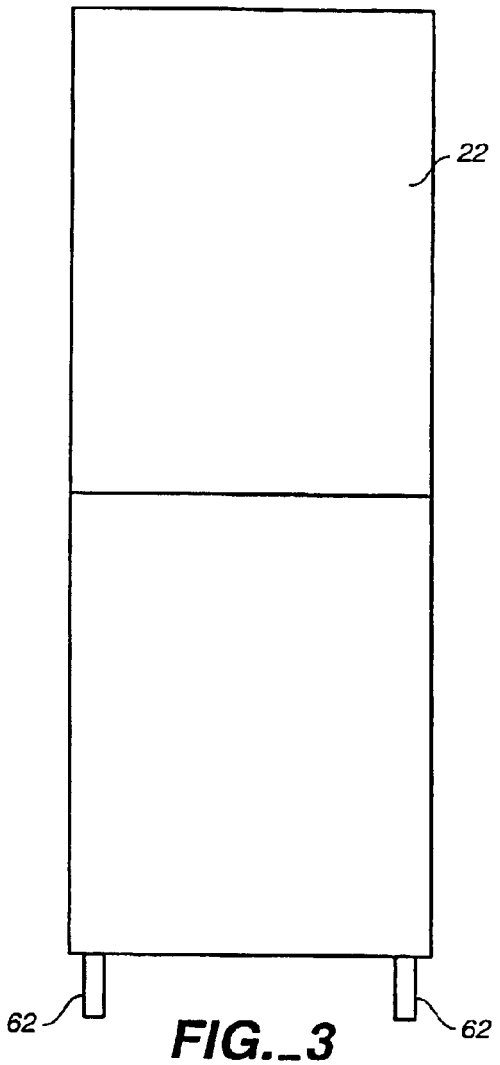
FIG. 3 is a rear view in elevation of the jet steam fabric finisher.

FIG. 1 is a perspective view of the low pressure jet steam fabric finisher of the present invention, generally denominated 10, and FIGS. 2 and 3 are front and rear elevation views thereof. This apparatus is a production level low pressure batch fabric steamer comprising a housing 12, preferably substantially cuboid in configuration and having a front side 14, top side 16, a right side 18, a left side 20, and a back side 22. The longitudinal dimension 24 of the housing is significantly longer than its lateral and transverse dimensions 26 and 28 respectively, adapted, thereby, to steam set a large, elongate bolt of fabric. Preferably the housing body is fabricated from panels of stainless steel connected to and supported by support members constituting an internal skeleton or frame (not shown). While this invention is not limited to any particular size for utility or effectiveness, a production scale steamer may have a remarkably small footprint of only approximately 22 by 75 inches (56 cm×190 cm). The preferred embodiment having this footprint has a complementary dimension of 49 inches in height (124 cm). With these dimensions, the maximum amount of fabric that can be processed in any given cycle is approximately 50 yards (46 m), in a maximum width of approximately 60 inches (152 cm) and a maximum roll diameter of approximately ten inches (25 cm)

The front side 14 of the housing has a front lockout door 30 pivotally connected to the front with a hinge 32. When open the door provides access to a hollow cylindrical steaming chamber 34, which has an opening 35 at its front end and which runs longitudinally almost the entire length of the steamer to within a few inches of the back side of the housing. Supported concentrically within the steaming chamber is a hollow cylindrical steaming core 36 having a plurality of holes through its sides for the passage of steam from the steaming core into the steaming chamber (see also FIGS. 4 and 5).

As shown in detail in FIG. 2, the front side 14 further includes a control panel 38 for operator control of the steamer. It should be noted that FIG. 1 shows the front side of the steamer having an optional storage bin 39 immediately underneath the control panel and having an access port in the lower portion of the front side. This may remain uncovered and open for easy access to storage space or, alternatively, it may be closed by an attached door. The access port need not be included and has no functional role in the operation of the apparatus.

The control panel includes a pressure gauge 40, a temperature gauge showing current temperature 42, an electronic timer and temperature control 44 for setting the time and temperature of the steam cycle, a cycle indicator light 46, a door lock indicator light 48, a "water full" indicator light 50, an "add water" indicator light 52, a power/start cycle switch 54, a power on indicator light 56, a heater on indicator light 58, and an emergency shut-off knob 60.

FIG. 3 shows that the rear side 22 of the steamer comprises a simple enclosure. Another advantage of the fabric steamer of the present invention is its portability. The steamer is preferably set on wheels 62, preferably comprising locking casters.

Figure 4:
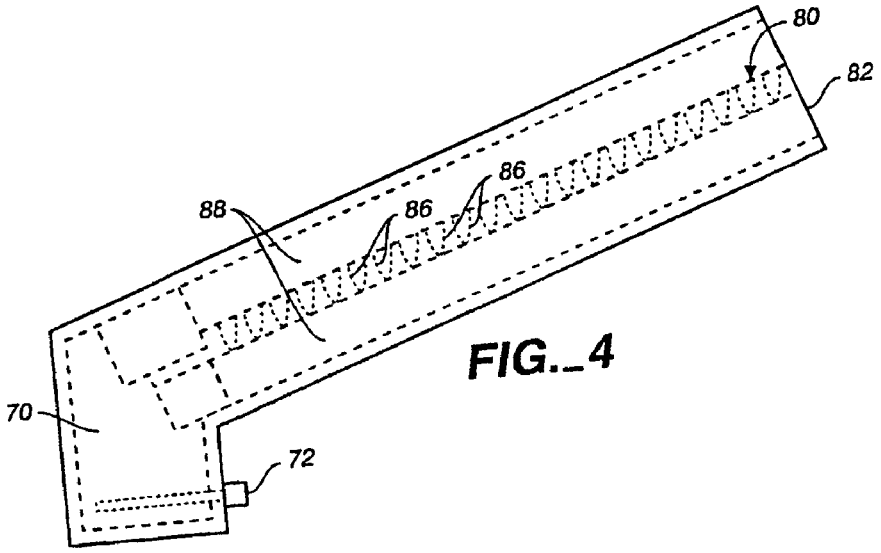
FIG. 4 is a side elevation view of the internal canister of the steam finisher, showing the steaming core and heating element in phantom.
Figure 5:
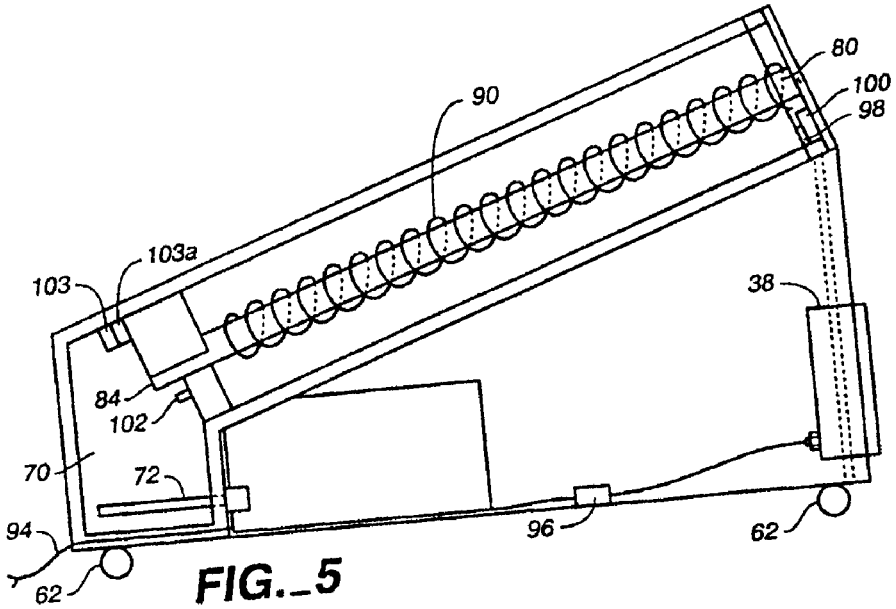
FIG. 5 is a side elevation cross sectional view of the fabric steamer.

FIG. 4 is a side elevation view of the inner canister of the fabric steamer of the present invention (including the steaming core and heating element shown in phantom). FIG. 5 is a side elevation cross sectional view of the fabric steamer. These views show that the steamer interior includes a water reservoir 70, into which heating element 72 is positioned near its base. The heating element is preferably controlled with a 1/16 DIN controller or other suitable device. When the steamer is manufactured with the specific dimensions set out above, the reservoir is approximately three gallons (11.3 L), though, once again, such a volume does not constitute a necessary limitation for the functionality of the invention. The heating element 74 is preferably powered by 220V single phase power supply and heats water to produce steam up to a temperature of 250° F. (121° C.) or higher.

The cylindrical hollow steaming core 80 extends longitudinally from a point 82 near the front door and terminates in a steam inlet 84 proximate the back of the steamer at the water reservoir 70, with which it is in open communication. Steam generated by the heating element rises from the reservoir and migrates into the steaming core through the steam inlet and passes through a plurality of holes 86 through the cylinder walls of the steaming core and into the steaming chamber 88, which entirely surrounds the steaming core.

When dyed and printed fabrics are to be steam fixed, the dyed or printed fabric is rolled into a layered sandwich over helical spring coil 90, and each layer of fabric is separated by steaming paper. The coil is slid over the steam core and supported (along with the steam core itself) by and steaming core support 92 shown in FIG. 7, which comprises a ring and two or more arms and which is inserted over the steam core and positioned within the interior cylinder walls of the steaming chamber to center and position the steaming core within the steaming core chamber when a roll of fabric is inserted for steaming.

The control panel 38 is preferably electrically connected via a power cord 94 to a standard 110V power supply with an interposing heavy duty breaker 96. Electrically connected components and devices may include a power on light, a cycle timer, a temperature control, a water heater element, a water full light, an add water light, a door closed light, a cycle control/power on button, and a cycle on light (all described above); and may further include a door closed switch 98, a door lock solenoid 100, a temperature probe 102, a pressure valve 103 and pressure valve solenoid 103*a* for releasing steam and pressure from the steaming chamber after a cycle is completed, a power relay, a time delay (not shown), and other features as modified.

Figure 6:
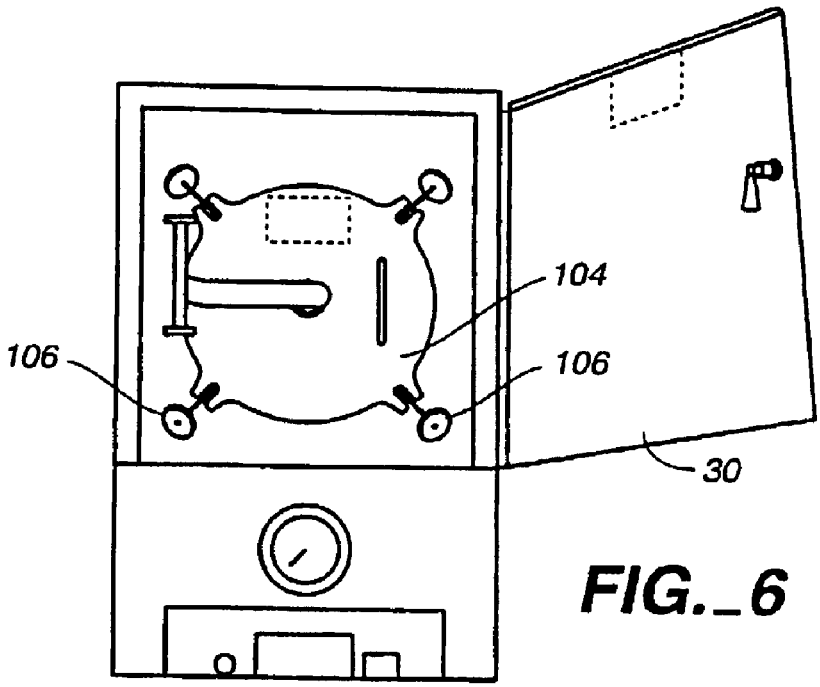
FIG. 6 is a front end perspective view of the fabric finisher showing the top door open and the steaming core door closed but unsecured.
Figure 7:
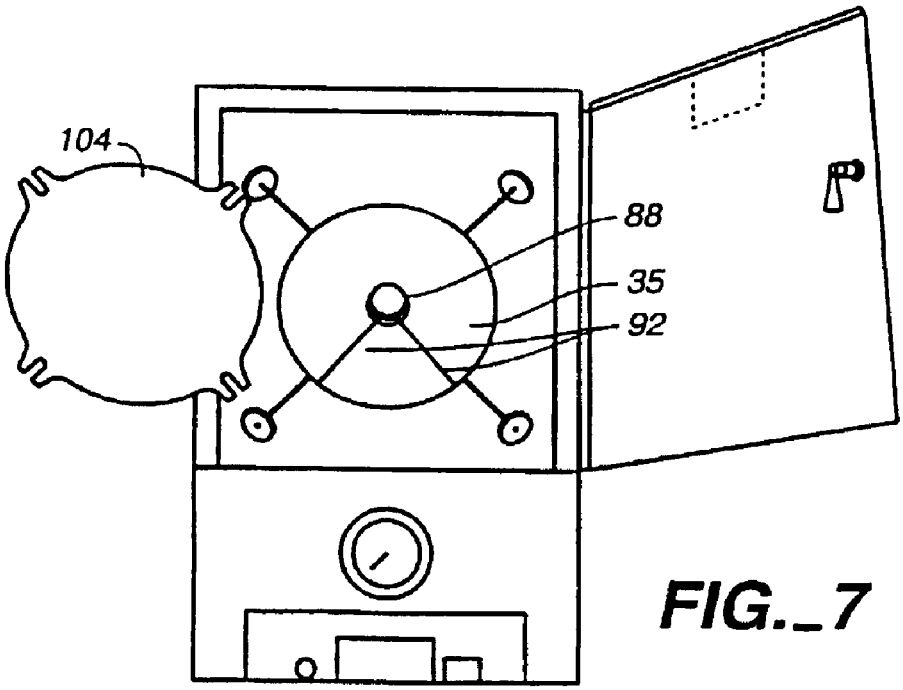
FIG. 7 is a front end perspective view of the fabric finisher showing the top door open and the steaming core door open, exposing the interior of the steaming core.

FIG. 6 is a front end perspective view of the fabric finisher showing the front (outer) door 30 open and the sealable steaming core pressure door 104 closed but unsecured. FIG. 7 is a front end perspective view of the fabric finisher showing the front door 30 open and the steaming core pressure door 100 open, thus exposing the steaming core 80 and the steaming core chamber 88. The pressure door 104 is secured before operation by a plurality of pressure door clamps 106, preferably swiveling locking bolts with knobs for hand tightening, which pivotally engage a plurality of complementary slots.

As may be readily appreciated, the low pressure fabric steamer will not operate with the front door open. Once the front door is closed, it will automatically lock via a solenoid when the power to the system is turned on at on/off button. The system is then sealed. If a finishing cycle is begun, the heating element will heat reservoir water to generate steam up to temperatures of 250° F. (121° C.). The steam migrates upwardly and then into and through the steam core as described above to create chamber pressures of between 15 psi to 30 psi (1.02–2.04 Pa). The combination of tightly controlled heat and pressure fixes dyes and inks rapidly and thoroughly. The electronic time and temperature controls provide the user with the means to tailor the fixing process precisely to the fabrics and dyes employed.

Fabric steaming cycle times and recommended steaming temperatures will, of course, vary according to the type of fabric. Silk, nylon and wool are generally steamed at 222° F. (106° C.) for 10 to 20 minutes; cotton and rayon are steamed at approximately 220° F. (104° C.) for only 6 to 10 minutes, depending on the amount of fabric.

To use the inventive apparatus, the following steps are including:

(1) Peeling the dyed fabric to be steamed from its backing paper, working across the width of the fabric and separating the fabric and paper along the length of the fabric, and flattening it;

(2) Removing the helical spring coil from the steaming core;

(3) Rolling five or six layers of steaming tissue onto the helical spring coil;

(4) Placing flattened fabric on the tissue paper and rolling it into layers over the helical coil;

(5) Rolling five to six layers of steaming tissue over the outside of the rolled fabric;

(6) Securing the fabric roll with rubber bands;

(7) Opening the front lockout door and the steaming core pressure door;

(8) Ensuring that the water level is sufficient by checking the water level light and filling the water reservoir with distilled water if needed;

(9) Placing the rolled fabric on the steaming core in the center of the steaming chamber;

(10) Positioning the core support over the end of the steaming core;

(11) Securing the pressure door by tightening the pressure door clamp knobs;

(12) Closing the front lockout door;

(13) Turning on the power to the steamer;

(14) Setting the desired steaming cycle temperature and time;

(15) Turning the control switch to the start position;

(16) After the cycle is completed, waiting until the pressure in the steaming chamber is indicated on the pressure gauge as 0 (at which point the front lockout door solenoid will unlock the lockout door);

(17) Opening the front lockout door and steaming chamber pressure door and removing the fabric and spring core;

(18) Unrolling the fabric and disposing of the steaming tissue.

What is claimed as invention is:

1. A low pressure steam jet fabric finisher for steam setting of dyes on fabric during a steaming cycle, said apparatus comprising:

a housing defining a water reservoir 70 and a steaming chamber 88, said steaming chamber having an opening at its front end 35, said steaming chamber in fluid communication with said water reservoir via a steam inlet 84;

a steaming chamber pressure door 104 at said front end 35 having clamping means 106 to clamp shut said pressure door and for providing a pressure-tight seal to said steaming chamber;

heating means 72 to heat water in said water reservoir;

a hollow steaming core 80 positioned within said steaming chamber, said steaming core having a plurality of apertures for the passage of steam from said steaming core into said steaming chamber;

support means 90 adapted to fit over said steaming core while supporting a sheet of fabric and keeping it separate from the steaming core during the steaming cycle; and control means 38 for providing operator control of the start, duration, and temperature of the fabric steaming cycle;

characterized in that when the steaming cycle is commenced, said heating element heats water in said water reservoir to create steam, which passes into said steaming core and thereafter through said plurality of holes in said steaming core into said steaming chamber to set inks and/or dye on fabric.

2. The apparatus of claim 1, characterized in that said heating means is an electric heating element 72.

3. The apparatus of claim 1, characterized in that said housing has a front side 14 with a front lockout door 30 connected by a hinge 32 to said front side, and further includes a top side 16, a right side 18, a left side 20. and a back side 22, and wherein said steaming chamber is substantially cylindrical and has an opening at its front end 35 accessible when said front lockout door is open.

4. The apparatus of claim 3, further characterized in that said front lockout door engages an electronic switch 98 which activates a solenoid 100 to lock and seal said front lockout door.

5. The apparatus of claim 1 wherein said steaming chamber pressure door characterized in that said steaming core is substantially cylindrical and is concentrically positioned within said steaming chamber.

6. The apparatus of claim 1, further characterized in that said support means comprises a helical coil spring 90 substantially the length of said steaming core and adapted to slide over said steaming core while supporting a rolled sheet of fabric during the steaming cycle.

7. The apparatus of claim 1, further characterized in that said control means comprises a control panel having a pressure gauge 40, a temperature gauge 42 showing current temperature, an electronic timer and temperature control 44 for setting the time and temperature of the steam cycle, a cycle indicator light 46, a door lock indicator light 48, a "water full" indicator light 50, an "add water" indicator light 52, a power/start cycle switch 54, a power on indicator light 56, a heater on indicator light 58, and an emergency shut-off knob 60.

8. The apparatus of claim 1, further characterized in that said clamping means comprises a plurality of hand tightened door clamps 106.

9. A low pressure steam jet fabric finisher for steam setting of dyes on fabric during a steaming cycle, said apparatus comprising:

a housing 12 having a front side 14 with a front lockout door 30 connected by a hinge 32 to said front side, and further having a top side 16, a right side 18, a left side 20, and a back side 22, said housing defining a water reservoir 70 and a substantially cylindrical steaming chamber 88 having an opening at its front end 35 accessible when said front lockout door is open, said steaming chamber in fluid communication with said water reservoir via a steam inlet 84;

a sealable steaming chamber pressure door 104 having clamping means 106 to clamp shut said pressure door and for providing a pressure-tight seal to said steaming chamber;

a heating element 72 proximate said water reservoir for heating water in said water reservoir;

a cylindrical hollow steaming core 80 concentrically positioned within said steaming chamber, said steaming core having a plurality of apertures for the passage of steam from said steaming core into said steaming chamber;

a helical coil spring 90 substantially the length of said steaming core and adapted to slide over said steaming core while supporting a rolled sheet of fabric during the steaming cycle;

a steaming core support 92 inserted over said steaming core and positioned within the interior cylinder walls of the steaming chamber to center and position the steaming core within the steaming core chamber when a roll of fabric is inserted for steaming; and control means 38 for providing operator control of the start, duration, and temperature of the fabric steaming cycle;

characterized in that when the steaming cycle is commenced, said heating element heats water in said water reservoir to create steam, which passes into said steaming core and thereafter through said plurality of holes in said steaming core into said steaming chamber to set inks and/or dye on fabric.

10. A method of low pressure steam setting dyes on fabric, said method comprising the steps of:

(1) providing a low pressure steam jet fabric finisher for steam setting of dyes on fabric during a steaming cycle, said apparatus comprising:

a housing 12 having a front side 14 with a front lockout door 30 connected by a hinge 32 to said front side, and further having a top side 16, a right side 18, a left side 20, and a back side 22, said housing defining a water reservoir 70 and a substantially cylindrical steaming chamber 88 having an opening at its front end 35 accessible when said front lockout door is open, said steaming chamber in fluid communication with said water reservoir via a steam inlet 84; a steaming chamber pressure door 104 for closing and providing a pressure-tight seal to said steaming chamber; means 106 to clamp said pressure door; a heating element 72 inserted into said water reservoir; a cylindrical hollow steaming core 80 concentrically positioned within said steaming chamber, said steaming core having a plurality of apertures for the passage of steam from said steaming core into said steaming chamber; a helical coil spring 90 substantially the length of said steaming core and adapted to slide over said steaming core while supporting a rolled sheet of fabric during the steaming cycle; a steaming core support 92 for supporting and centering said steaming core within said steaming chamber during a steaming cycle; and control means 38 for providing operator control of the start, duration, and temperature of the fabric steaming cycle;

(2) peeling any backing paper from the dyed fabric and flattening the fabric;

(3) removing the helical spring coil from the steaming core;

(4) rolling a plurality of layers of steaming tissue onto the helical spring coil;

(5) placing the flattened fabric on the tissue paper and rolling it into layers over the helical coil;

(6) rolling a plurality of layers of steaming tissue over the outside of the rolled fabric;

(7) securing the fabric roll with rubber bands;

(8) opening the front lockout door and the steaming core pressure door;

(9) ensuring that the water level is sufficient by checking the water level light, and filling the water reservoir with distilled water if needed;

(10) placing the rolled fabric on the steaming core in the center of the steaming chamber;

(11) positioning the steaming core support over the end of the steaming core;

(11) securing the pressure door by tightening the pressure door clamp knobs;

(12) closing the front lockout door;

(13) turning on the power to the steamer;

(14) setting the desired steaming cycle temperature and time;

(15) starting the steaming cycle;

(16) after the cycle is completed, removing opening the front lockout door and steaming core pressure door and removing the fabric from the steamer.

* * * * *